US006315234B1

(12) United States Patent
Oishi

(10) Patent No.: US 6,315,234 B1
(45) **Date of Patent: *Nov. 13, 2001**

(54) APPARATUS FOR UNWINDING WIRE MATERIAL UNDER CONSTANT TENSION

(75) Inventor: Hiroyuki Oishi, Kuroiso (JP)

(73) Assignee: Bridgestone Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,850

(22) Filed: Mar. 30, 1999

(30) Foreign Application Priority Data

Apr. 14, 1998 (JP) ..... 10-102621

(51) Int. Cl.[7] ..... B65H 23/06
(52) U.S. Cl. ..... 242/421.8
(58) Field of Search ..... 242/421.8, 421.9

(56) References Cited

U.S. PATENT DOCUMENTS 1,946,313 2/1934 Daniels .
2,562,990 8/1951 Peebles .
3,076,618 2/1963 Van Hook .
3,912,191 10/1975 Anderson et al. .
5,772,142 * 6/1998 Ahn ..... 242/421.8 X

FOREIGN PATENT DOCUMENTS 4100173 7/1992 (DE) .
576994 4/1946 (GB) .
864989 4/1961 (GB) .
2267295 12/1993 (GB) .

* cited by examiner

*Primary Examiner*—John Q. Nguyen
(74) *Attorney, Agent, or Firm*—Sughrue, Mion, Zinn, Macpeak & Seas, PLLC

(57) ABSTRACT

An apparatus for unwinding a wire material under constant tension comprises a braking face (3) rotating together with a reel wound with a wire material, a brake band (4) contacting with the braking face (3), a brake control mechanism connected to an end of the brake band (4) for controlling a tension of the brake band (4) to control a braking force, and a deformation control device (5) for restricting deformation in at least a part of the brake band (4).

4 Claims, 7 Drawing Sheets

APPARATUS FOR UNWINDING WIRE MATERIAL UNDER CONSTANT TENSION

BACKGROUND OF THE INVENTION

1. Field of the Invention

This invention relates to an apparatus for unwinding a wire material from a reel, spool or the like under constant tension.

2. Description of Related Art

In FIG. 1 is shown an embodiment of the conventional apparatus for unwinding a wire material under constant tension, in which a reel 20 winding a wire material 22 is placed on a spindle shaft 1 by inserting a support portion 2 of the shaft 1 into a hole 21 of the reel 20. The wire material 22 is unwound from the reel 20 through fixed rolls 10, 11 and a dancer roll 6 as shown by a phantom line. The dancer roll 6 is placed on an end of a rotatably arranged dancer arm 7. A cylindrical portion 13 is coaxially arranged on the dancer arm 7 with respect to the rotating axis thereof. A brake band 4 is connected at its one end to the dancer arm 7 and fixed at the other end to a fixed portion 12 through contacting with the cylindrical portion 13 and a braking face 3.

The dancer arm 7 is energized by a spring 8 fixed at its one end to a spring fixed portion 14 in a direction shown by an arrow X or in a direction of increasing a tension of the brake band 4 to increase a contact pressure to the braking face 3. On the other hand, the dancer arm 7 is subjected to a rotating force by the tension of the wire material 22 through the dancer roll 6 in a direction shown by an arrow Y or in a direction of decreasing the tension of the brake band 4 to decrease the contact pressure to the braking face 3. Thus, a braking force to the rotation of the spindle shaft 1 is controlled by a balance between the rotating force and the energizing force through the spring 8.

That is, when the tension of the wire material 22 decreases during the unwinding of the wire material 22, the dancer arm 7 rotates in the direction of arrow X and hence the tension of the bake band 4 and the contact pressure to the braking face 3 are increased to increase the tension of the wire material 22. On the other hand, when the tension of the wire material 22 increases, the dancer arm 7 rotates in the direction of arrow Y and hence the tension of the bake band 4 and the contact pressure to the braking face 3 are decreased to decrease the tension of the wire material 22.

In the conventional apparatus, therefore, it is desired to maintain the unwinding tension of the wire material at an approximately constant value by controlling the change of tension in the wire material to be unwound through the above construction and function.

However, when the dancer arm 7 rotates in the direction of arrow Y to decrease the tension of the brake band 4, there is caused a problem that the looseness of the brake band 4 is caused and the control of the unwinding tension is not conducted smoothly. Particularly, this problem is apt to be caused when the tension of the brake band 4 is set to a relatively low value for unwinding the wire material under a low tension.

In FIG. 1, a phantom line W1 shows a state of loosing the brake band 4 to form a curved deformation in the vicinity of the contact portion with the braking face 3. As such a curved deformation is created, the contact area to the braking face 3 decreases to excessively decrease the braking force and hence there is caused a problem that the tension change of the wire material 22 becomes large. Also as the braking force excessively decreases, the tension of the brake band 4 rapidly increases to increase the tension of the wire material 22 and hence there is caused a problem that breakage or hunting phenomenon of the wire material occurs.

On the other hand, when the brake band 4 is curvedly deformed in the vicinity of a connected portion to the dancer arm 7 as shown by a phantom line W2, the brake band 4 rises to the cylindrical portion 13 and it is difficult to reflect the movement of the dancer arm 7 to the change of the braking force and hence the tension of the wire material 22 becomes not smoothly controlled.

SUMMARY OF THE INVENTION

It is, therefore, an object of the invention to solve the afore-mentioned problems in the conventional unwinding apparatus and to provide an apparatus for unwinding a wire material capable of smoothly controlling the unwinding tension of the wire material even if the tension of the brake band decreases and always unwinding the wire material under a stable tension.

According to the invention, there is the provision of an apparatus for unwinding a wire material under constant tension, which comprises a braking face (3) rotating together with a reel wound with a wire material, a brake band (4) contacting with the braking face (3) and a brake control means connected to an end of the brake band (4) for controlling a tension of the brake band (4) to control a braking force, characterized by providing a deformation control means (5) for restricting deformation in at least a part of the brake band (4).

In a preferable embodiment of the invention, the deformation control means (5) is arranged at a position near to a contact starting point of the brake band (4) to the braking face (3) or a position near to a connected portion of the brake band (4) to the brake control means or at both positions in a region ranging from the brake control means to the braking face (3).

In another preferable embodiment of the invention, the brake control means comprises a dancer arm (7) and a brake energizing means (9) for energizing the dancer arm (7) in a direction of raising a contact pressure between the braking face (3) and the brake band (4) and the dancer arm (7) is provided with a dancer roll (6) and a cylindrical portion (13) coaxially arranged with respect to a rotating axis of the roll (6). In this case, the brake band (4) is connected at its one end to the dancer arm (7) and arrived to the braking face (3) through the cylindrical portion (13) and the deformation control means (5) is arranged so as to restrict deformation of a portion of the brake band (4) contacting with the cylindrical portion (13).

In the unwinding apparatus for the wire material under constant tension according to the invention, the change of the unwinding tension can be controlled even if the tension of the brake band (4) is set to a relatively low value for unwinding the wire material under a low tension, so that a brake adjusting means for adjusting a contact pressure between the brake band (4) and the braking face (3) can be arranged to provide an apparatus having a high general-purpose condition.

In the unwinding apparatus for the wire material under constant tension according to the invention, the deformation control means (5) solves problems accompanied with the curved deformation of the brake band (4). As the deformation control means, a plate-shaped guide, a rod-shaped guide or the like may be arranged at one-side or both sides of the brake band (4) and adjacent thereto. And also, means for raising a rigidity of the brake band (4) itself may be applied as the deformation control means (5). For example, a rigid member such as a metal plate, a plastic plate or the like may be adhered to a side surface of the brake band (4), or a part of the brake band (4) may be replaced with a rigid member such as a metal plate, a plastic plate or the like.

When the deformation control means 5 is arranged in the vicinity of a contact starting point of the brake band (4) to the braking face (3) in a region ranging from the braking face (3) to the brake control means, there can be prevented the curved deformation (W1) of the brake band (4) in the vicinity of the contact starting point to the braking face (3) as shown in FIG. 1. Thus, the contact area between the brake band (4) and the braking face (3) is maintained at a constant value and the rapid change or hunting phenomenon in the tension of the wire material (22) is prevented.

On the other hand, when the deformation control means (5) is arranged in the vicinity of the connected portion, there can be prevented the curved deformation W2 of the brake band (4) in the vicinity of the connected portion to the brake control means as shown in FIG. 1. Thus, the control of the tension of the brake band (4) can be conducted smoothly by the brake control means.

Although the deformation control means (5) in the vicinity of the contact starting point to the braking face (3) and the deformation control means (5) in the vicinity of the connected portion to the brake control means can be used alone, respectively, the better result is obtained by using both the deformation control means together. Also, it is effective to arrange the deformation control means (5) over a full region ranging from the brake control means to the braking face (3).

As the brake control means, there can be applied a complicated means wherein the unwinding tension of the wire material is electrically detected and the tension of the brake band is controlled based on the detected signal. However, the sufficient effect can be obtained even in a simple means of dancer roll system as shown in FIG. 1. Particularly, it is favorable that the cylindrical portion (13) is coaxially arranged with respect to the rotating axis of the dancer arm (7) and the brake band (4) is connected at its one end to the dancer arm (7) and arrives at the braking face (3) through the contacting with the cylindrical portion (13) because a track of a straight line connecting the contact ending point to the cylindrical portion (13) to the contact starting point to the braking face (3) is unchangeable even in the rotation of the dancer arm (7), so that even when the plate-shaped guide, rod-shaped guide or the like as the deformation control means (5) is arranged adjacent to the brake band (4), it hardly interferes the brake band (4).

Further, when the deformation control means (5) is arranged so as to restrict the deformation in a portion of the brake band (4) contacting with the cylindrical portion (13) while adopting the above brake control means, the control of braking force through the dancer arm (7) is smoothly conducted and also the stability to disturbance is improved.

BRIEF DESCRIPTION OF THE DRAWINGS

The invention will be described with reference to the accompanying drawings, wherein.

DESCRIPTION OF PREFERRED EMBODIMENTS

Figure 1A:
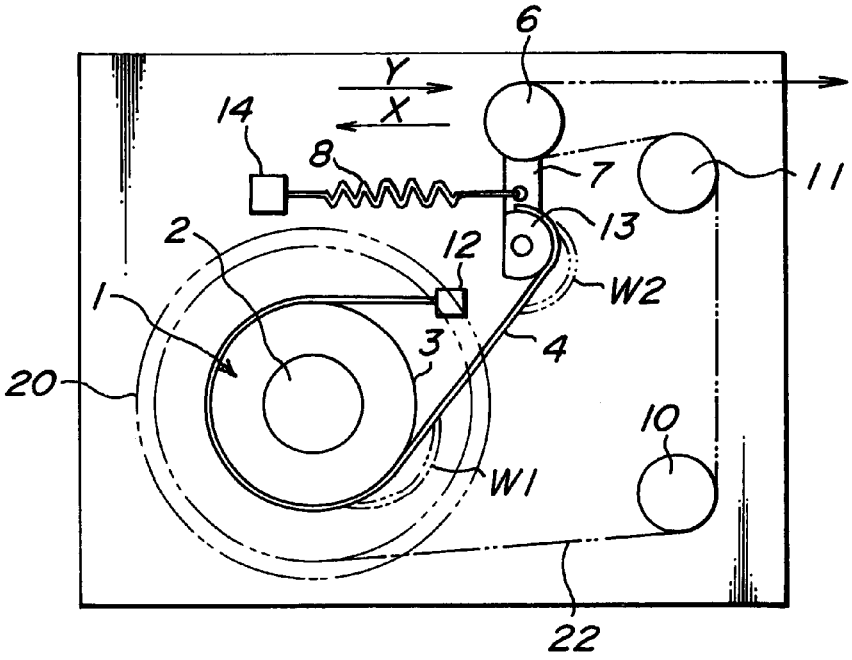
FIG 1a PRIOR ART
FIGS. 1*a* and 1*b* are plan and front views of the conventional un-winding apparatus for the wire material under constant tension, respectively.
Figure 1B:
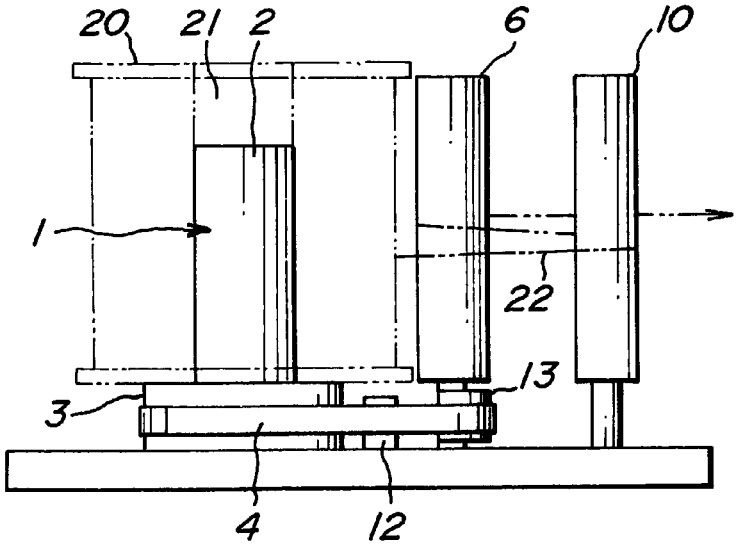
FIG 1b PRIOR ART
Figure 2A:
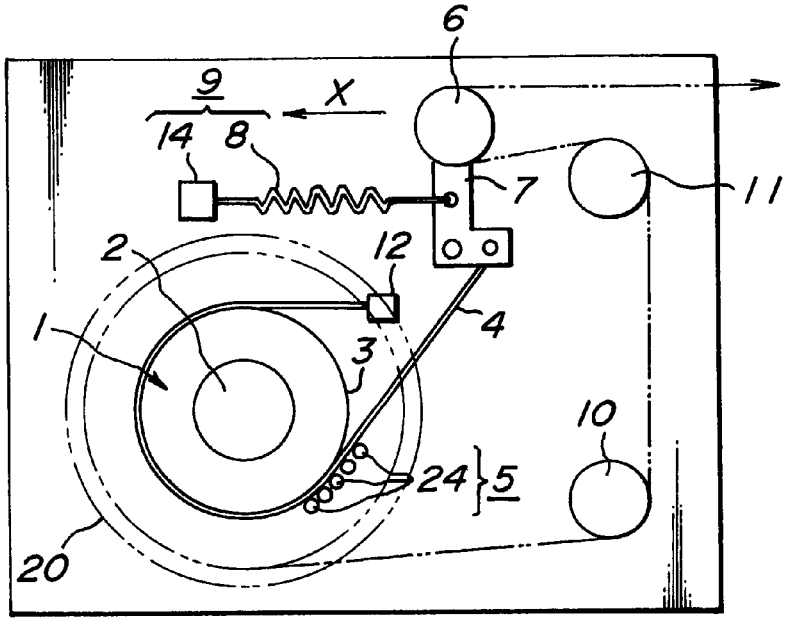
FIGS. 2*a* and 2*b* are plan and front views of a first embodiment of the unwinding apparatus for the wire material under constant tension according to the invention, respectively.
Figure 2B:
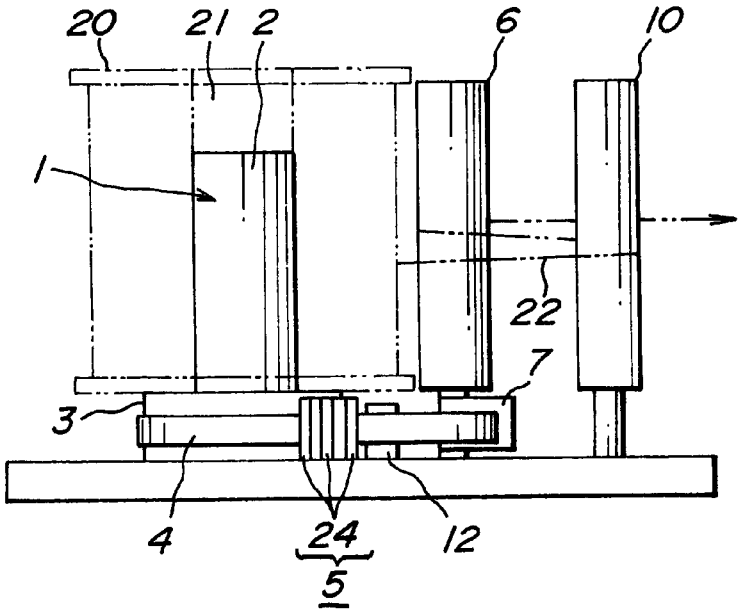

A first embodiment of the unwinding apparatus for the wire material under constant tension according to the invention is described with reference to FIG. 2. A reel 20 wound with a wire material 22 is placed on a spindle shaft 1 by inserting a support portion of the shaft into a hole 21 of the reel, while the wire material 22 is unwound from the reel 20 through fixed rolls 10, 11 and a dancer roll 6 as shown by a phantom line. The spindle shaft 1 is provided with a cylindrical braking face 3 coaxially arranged with respect to a rotating axis of the shaft, so that a braking force is applied to the rotation of the spindle shaft 1 by a contact pressure to a brake band 4. An end of he brake band 4 is fixed to a fixed portion 12, while the other end thereof is connected to a dancer arm 7 provided with the dancer roll 6. A brake control means is constituted with the dancer arm 7 and a brake energizing means 9 for energizing the dancer arm 7 in a direction of raising the contact pressure between the braking face 3 and the brake band 4 (or in a direction shown by an arrow X). In this case, the brake energizing means 9 comprises a a spring 8 and a spring fixing portion 14, wherein an end of the spring 8 is fixed to the spring fixing portion 14 and the other end thereof is connected to the dancer arm 7. In the first embodiment of the apparatus according to the invention, a plurality of rod-shaped guides 24 are arranged at one side of the brake band 4 and adjacent thereto in the vicinity of a contact starting point to the braking face 3 as a deformation control means 5, whereby the curved rising of the brake band 4 from the braking face 3 is prevented.

Figure 3A:
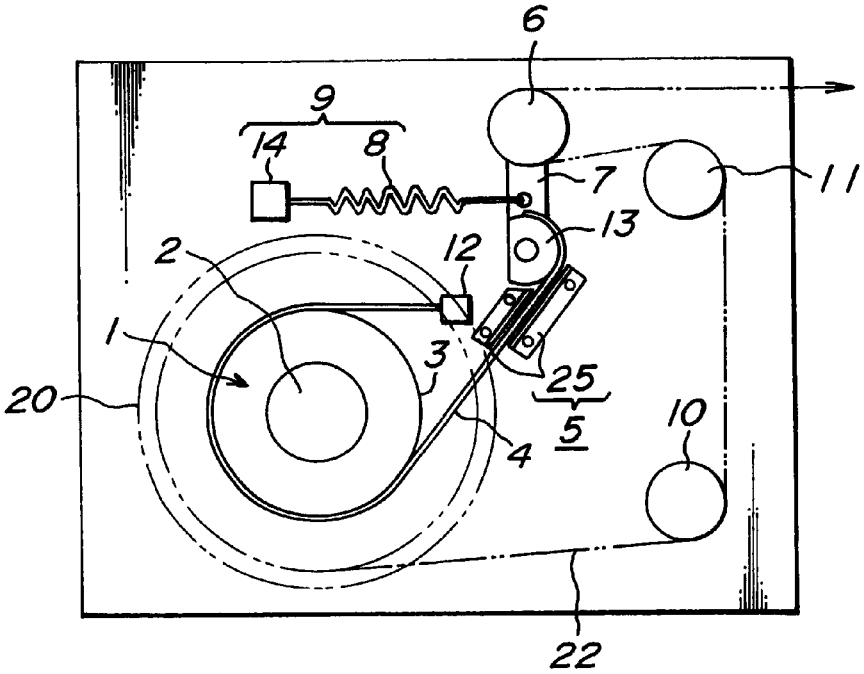
FIGS. 3*a* and 3*b* are plan and front views of a second embodiment of the unwinding apparatus for the wire material under constant tension according to the invention, respectively.
Figure 3B:
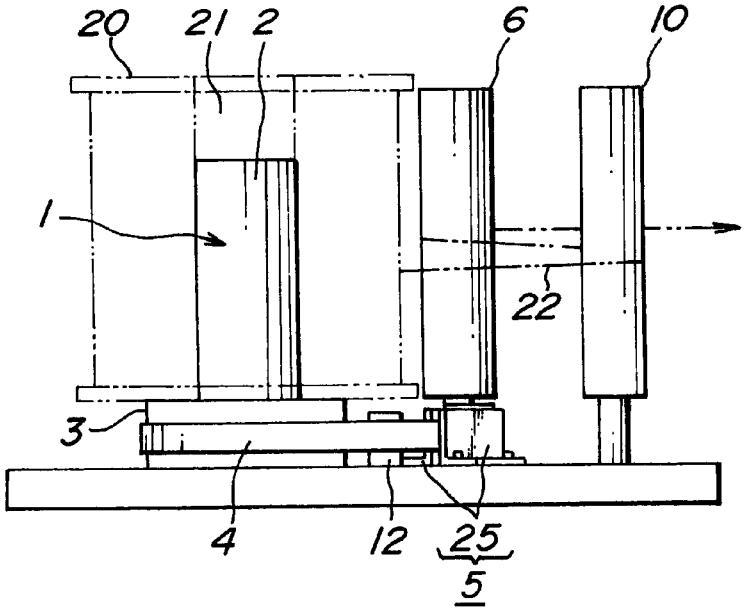

A second embodiment of the unwinding apparatus for the wire material under constant tension according to the invention is shown in FIG. 3. According to the second embodiment of the invention, the dancer arm 7 is provided with a cylindrical portion 13 coaxially arranged with respect to the rotating axis of the arm, and the brake band 4 is fixed at its one end to the cylindrical portion 13 and arrives at the braking face 3 through contacting with the cylindrical portion 13. In this apparatus, a pair of plate-shaped guides 25 are arranged on both sides of the brake band 4 and adjacent thereto in the vicinity of the connected portion to the brake control means as a deformation control means 5, whereby the curved deformation of the brake band 4 is prevented and the control of braking force through the dancer arm is smoothened.

Figure 4A:
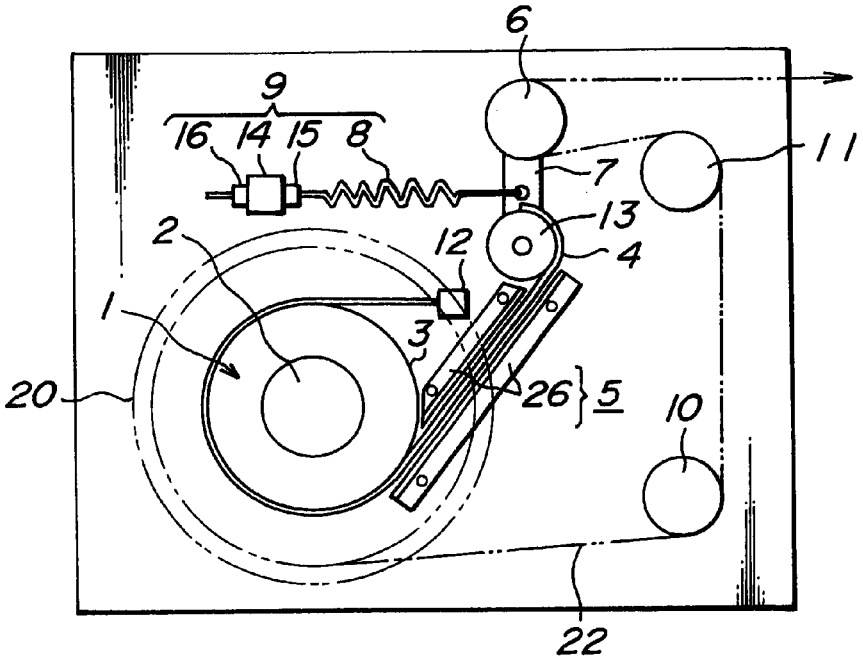
FIGS. 4*a* and 4*b* are plan and front views of a third embodiment of the unwinding apparatus for the wire material under constant tension according to the invention, respectively.
Figure 4B:
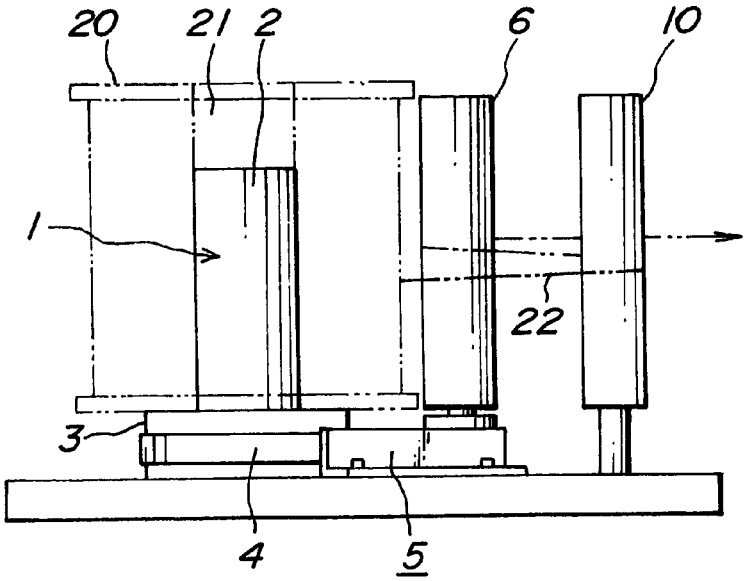

A third embodiment of the unwinding apparatus for the wire material under constant tension according to the invention is shown in FIG. 4. This apparatus has the same brake control means as in the second embodiment and is further provided with a brake adjusting means for adjusting the contact pressure between the brake band 4 and the braking face 3. The brake adjusting means is constructed by inserting a threaded end portion of the spring 8 into a through-hole of the spring fixing portion 14 and fixing the end portion through nuts 15 and 16 engaging therewith. In this case, the length of the spring 8 is adjusted by the rotation of the nuts 15, 16 to adjust an energizing force of the spring 8, whereby an unwinding tension of the wire material is set to a desired value.

In the apparatus of the third embodiment, a pair of plate-shaped guides 26 are arranged on both sides of the brake band 4 and adjacent thereto over substantially a full region ranging from the brake control means to the braking face 3 as a deformation control means 5. This deformation control means 5 simultaneously develops the deformation controlling effects of the first and second embodiments.

Figure 5A:
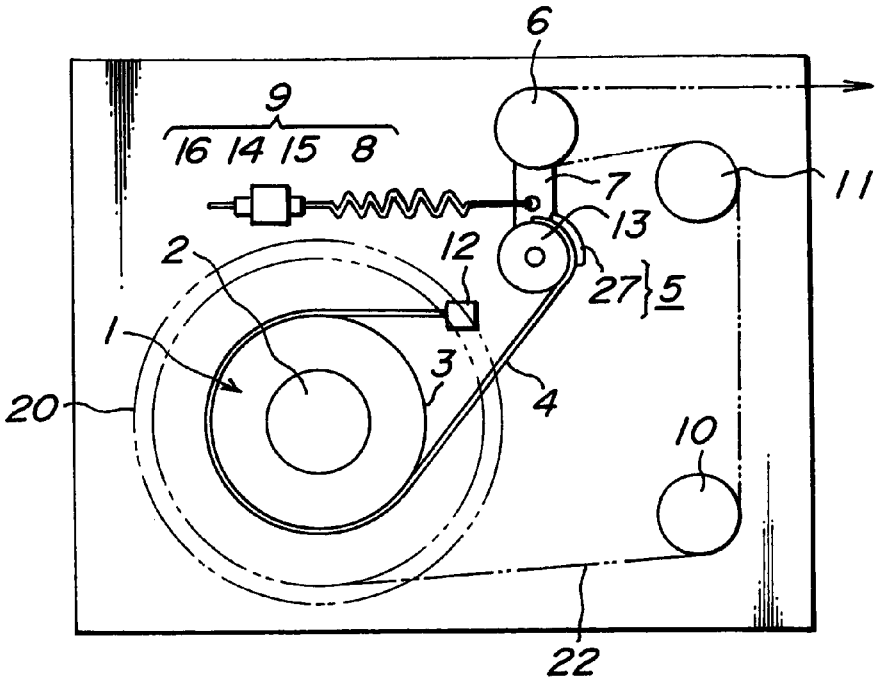
FIGS. 5*a* and 5*b* are plan and front views of a fourth embodiment of the unwinding apparatus for the wire material under constant tension according to the invention, respectively.
Figure 5B:
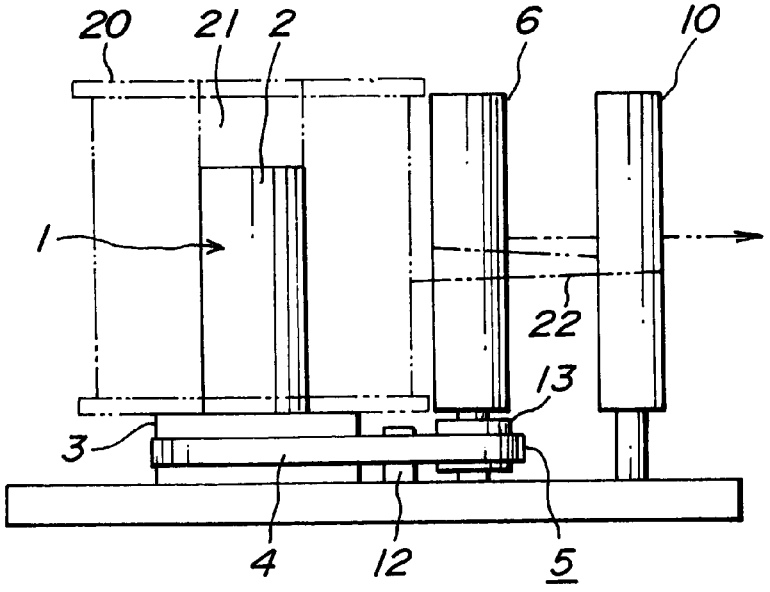

A fourth embodiment of the unwinding apparatus for the wire material under constant tension according to the invention is shown in FIG. 5. This apparatus has the same brake control means and brake adjusting means as in the third embodiment and is further provided with a deformation control means 5 for restricting the deformation in a portion of the brake band 4 contacting with the cylindrical portion 13. The deformation control means 5 is an iron plate 27 having a curvature along an outer circumference of the cylindrical portion 13, which is adhered to an outer side surface portion of the brake band 4 that contacts with the cylindrical portion 13. In this case, a time lag till the rotation of the dancer arm 7 reflects to the braking force is shortened to smoothly conduct the control of the braking force and improve the stability to disturbance.

Figure 6A:
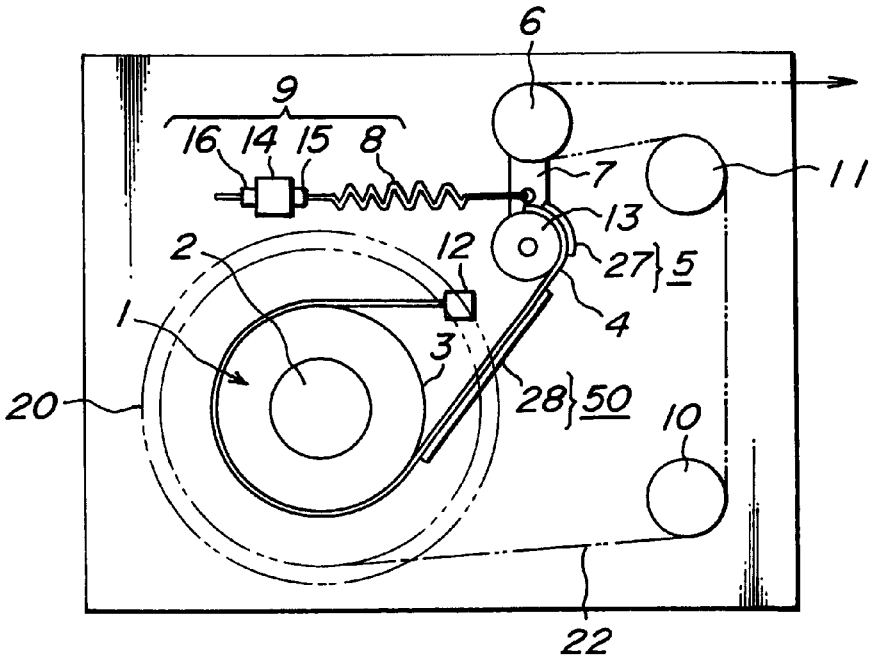
FIGS. 6*a* and 6*b* are plan and front views of a fifth embodiment of the unwinding apparatus for the wire material under constant tension according to the invention, respectively.
Figure 6B:
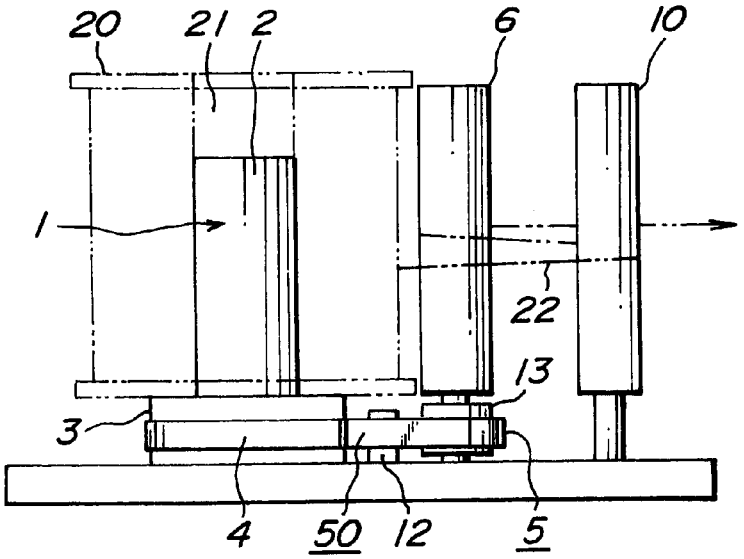

A fifth embodiment of the unwinding apparatus for the wire material under constant tension according to the invention is shown in FIG. 6. This apparatus is constructed by adding a second deformation control means 50 to the apparatus of the fourth embodiment. The second deformation control means 50 is a band-shaped iron plate 28 adhered to an outer side surface portion of the brake band 4 in a region ranging from the brake control means to the braking face 3, which develops the same effect as in the plate-shaped guide 26 in the third embodiment.

In the above embodiments, the brake adjusting means is disposed on the brake energizing means 9 to adjust the energizing force of the brake energizing means 9. Moreover, the brake adjusting means may be disposed on the fixed portion 12 for the brake band 4 so as to have a structure that the tension of the brake band 4 is adjusted by moving the position of the fixed portion 12 through, for example, a screw mechanism or the like. Alternatively, the brake adjusting means may be disposed on each of the brake energizing means 9 and the fixed portion 12 of the brake band 4.

TEST EXAMPLE

An unwinding test is carried out with respect to the apparatuses of the third, fourth end fifth embodiments and a comparative apparatus. The comparative apparatus is the same as in the third embodiment except that the deformation control means 5 is omitted. The test conditions and evaluation parameters are as follows.

(1) Test conditions

After 70 kg of a wire material of a high carbon steel having a diameter of 0.3 mm is wound around a reel, the wire material is unwound from the reel at a rate of about 160 m/min, in which a value P of tension at an initial unwinding stage is set to 3.0 kg or 1.5 kg. Moreover, the setting of such an initial unwinding tension is carried out by adjusting the energizing force of the spring 8 through the nuts 15, 16 in the brake adjusting means.

Figure 7:
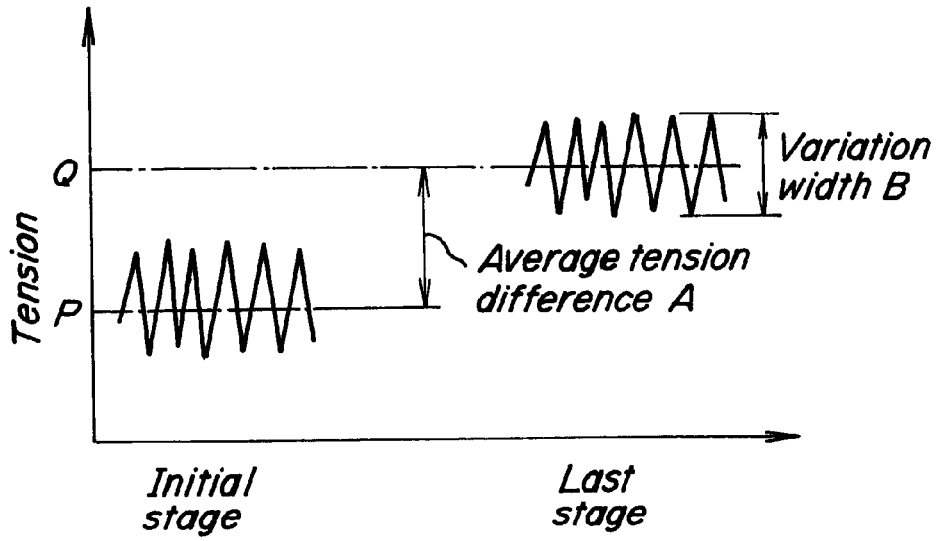
FIG. 7 is a representation illustrating an average tension and an average tension difference.

(2) Evaluation parameters (a) Average tension difference A between initial unwinding stage and last unwinding stage (see FIG. 7)

After the tension at the initial unwinding stage is set to a given value P (3.0 kg or 1.5 kg), the unwinding is started and continued, during which an average tension Q at a last unwinding stage is measured. A difference between P and Q is an average tension difference A. During the continuation of the unwinding, the weight of the wire material wound around the reel gradually decreases and the rotating speed of the reel increases. Therefore, as the change of the average tension is small and the value of the average tension difference A is small, the unwinding property becomes excellent.

(b) Variation width of tension B (see FIG. 7)

This is a variation width of the unwinding tension in up and down directions, which is measured at each of the initial unwinding stage and the last unwinding stage. The smaller the tension variation width B, the better the unwinding property.

Figure 8:
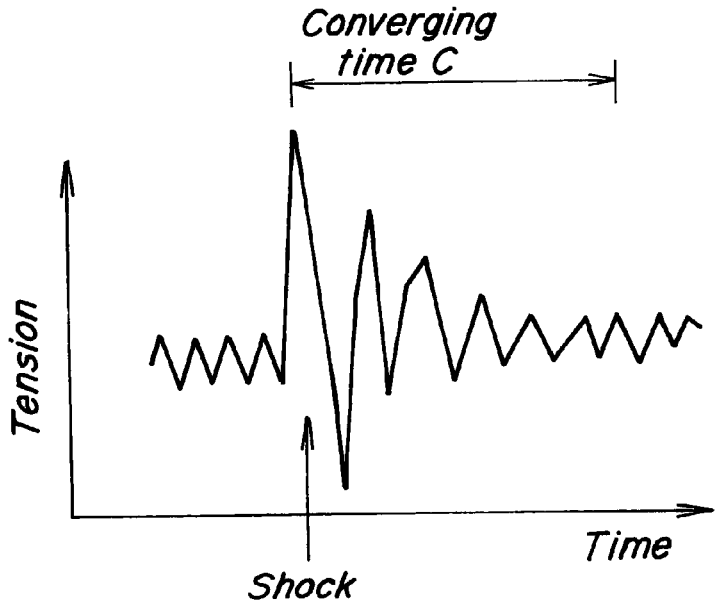
FIG. 8 is a representation illustrating a converging time.

(c) Converging time C (see FIG. 8)

After the tension of the wire material is intentionally changed by applying a dropping shock of a weight to the unwinding wire material, a converging time C required for converging the tension change is measured. The shorter the converging time C, the better the stability to disturbance.

The measured results are shown in Tables 1 and 2. Moreover, the average tension difference A is represented by a percentage to the initial tension set value P.

TABLE 1

| | | Third embodiment | Fourth embodiment | Fifth embodiment | Comparative Example |
|---|---|---|---|---|---|
| Average tension (kg) | initial stage | 3.00 | 3.00 | 3.00 | 3.00 |
| | last stage | 3.20 | 3.20 | 3.15 | 3.46 |
| | difference | 7% (47) | 7% (47) | 5% (33) | 15% (100) |
| Variation width (kg) | initial stage | 0.20(133) | 0.15 (100) | 0.15 (100) | 0.15 (100) |
| | last stage | 0.60(200) | 0.15 (50) | 0.20 (67) | 0.30 (100) |
| Converging time (second) | | 10 (167) | 4 (67) | 5 (83) | 6 (100) |

*Initial setting tension: 3.0 kg
Numerical value in parenthesis is an index value on the basis that Comparative Example is 100.

TABLE 2

| | | Third embodiment | Fourth embodiment | Fifth embodiment | Comparative Example |
|---|---|---|---|---|---|
| Average tension (kg) | initial stage | 1.50 | 1.50 | 1.50 | 1.50 |
| | last stage | 1.71 | 1.69 | 1.68 | 1.93 |
| | difference | 14% (48) | 13% (45) | 12% (41) | 29% (100) |
| Variation width (kg) | initial stage | 0.15 (75) | 0.10 (50) | 0.12 (60) | 0.20 (100) |
| | last stage | 0.80 (200) | 0.20 (50) | 0.25 (63) | 0.40 (100) |
| Converging time (second) | | 12 (100) | 6 (50) | 9 (75) | 12 (100) |

*Initial setting tension: 1.5 kg
Numerical value in parenthesis is an index value on the basis that Comparative Example is 100.

The apparatus of the third embodiment arranging the deformation control means 5 in a region ranging from the brake control means to the braking face 3 has an effect of making small the average tension difference A between the initial unwinding stage and the last unwinding stage. In the apparatuses of the fourth and fifth embodiments arranging the deformation control means 5 so as to restrict the deformation in the portion of the brake band 4 contacting with the cylindrical portion 13, there is obtained an effect of improving all evaluation parameters.

As mentioned above, in the apparatus for unwinding the wire material under constant tension according to the invention, the change of the unwinding tension is small and the wire material can be always unwound under an approximately constant tension over a period ranging from the initial unwinding stage to the last unwinding stage irrespectively of the set value of unwinding tension. Particularly, the apparatus according to the invention can be used as an unwinding apparatus in a twisting machine, in which poor twisting form or breakage due to the tension change can effectively be prevented.

What is claimed is:

1. An apparatus for unwinding a wire material under constant tension, comprising: a braking face (3) rotating together with a reel having a wire material wound on said reel, a brake band (4) contacting with said braking face (3) and brake control means connected to an end of the brake band (4) for controlling tension of the brake band (4) to control braking force, a deformation control means (5) for restricting curved deformation in at least a portion of the brake band (4) and arranged at a position outside of the brake band (4) at least in the vicinity of a contact starting point between the brake band (4) and the braking face (3) in a zone ranging from the brake control means to the braking face without extending over a full circumference of the braking face.

2. An apparatus according to claim 1, wherein the deformation control means (5) is a plate arranged at each of a position near to a contact starting point of the brake band (4) to the braking face (3) and a position near to a connected portion of the brake band (4) to the brake control means.

3. An apparatus according to claim 1, wherein the brake control means comprises a dancer arm (7) and a brake energizing means (9) for energizing the dancer arm (7) in a direction where a contact pressure increases between the braking face (3) and the brake band (4), said dancer arm (7) being provided with a dancer roll (6) and a cylindrical portion (13) coaxially arranged with respect to a rotating axis of the dancer arm (6), said brake band (4) connected at one end thereof to the dancer arm (7) and extending to the braking face (3) through the cylindrical portion (13) and, the deformation control means (5) is arranged to restrict deformation of a portion of the brake band (4) in contact with the cylindrical portion (13).

4. An apparatus according to claim 1, wherein the apparatus further comprises a brake adjusting means for adjusting a contact pressure between the brake band (4) and the braking face (3).

* * * * *